US010117490B2

(12) United States Patent
Singer et al.

(10) Patent No.: US 10,117,490 B2
(45) Date of Patent: Nov. 6, 2018

(54) COMPOSITIONS AND METHODS FOR MAKING HAIR BUNS

(71) Applicants: Michelle Lyn Singer, Ross, CA (US); Evan Laurence Singer, Ross, CA (US)

(72) Inventors: Michelle Lyn Singer, Ross, CA (US); Evan Laurence Singer, Ross, CA (US)

( * ) Notice: Subject to any disclaimer, the term of this patent is extended or adjusted under 35 U.S.C. 154(b) by 323 days.

(21) Appl. No.: 14/335,166

(22) Filed: Jul. 18, 2014

(65) Prior Publication Data

US 2015/0020839 A1 Jan. 22, 2015

Related U.S. Application Data

(60) Provisional application No. 61/856,316, filed on Jul. 19, 2013.

(51) Int. Cl.

| | |
|---|---|
| ***A45D 8/36*** | (2006.01) |
| ***A45D 8/34*** | (2006.01) |
| ***A45D 8/00*** | (2006.01) |
| ***A45D 8/38*** | (2006.01) |

(52) U.S. Cl.

CPC ..... *A45D 8/36* (2013.01); *A45D 8/34* (2013.01); *A45D 8/38* (2013.01); *A45D 2008/004* (2013.01)

(58) Field of Classification Search

CPC ... A45D 8/40; A45D 8/36; A45D 8/34; A45D 8/00; A45D 2008/006; A45D 2008/004; A45D 2007/004; A45D 2007/002

USPC ..... 132/200, 210, 273, 275

See application file for complete search history.

(56) References Cited

U.S. PATENT DOCUMENTS

| | | | | |
|---|---|---|---|---|
| 2,765,798 | A * | 10/1956 | Carvell | 132/55 |
| 3,693,637 | A * | 9/1972 | Sidelman | 132/55 |
| 3,727,659 | A * | 4/1973 | Shuford | 150/160 |
| 5,584,309 | A * | 12/1996 | De Beneditis et al. | 132/208 |
| 5,727,575 | A * | 3/1998 | Rontal | 132/200 |
| 5,816,265 | A * | 10/1998 | Ringo | 132/55 |
| 5,833,335 | A * | 11/1998 | Voughlohn | 132/273 |
| 5,970,991 | A * | 10/1999 | Srivastava | 132/274 |
| 8,061,366 | B2 * | 11/2011 | Britton et al. | 132/200 |
| 2010/0242980 | A1 * | 9/2010 | D'Assis et al. | 132/200 |
| 2012/0211021 | A1 * | 8/2012 | Hsu | 132/276 |
| 2014/0048094 | A1 * | 2/2014 | Carriedo | 132/210 |
| 2015/0096580 | A1 * | 4/2015 | Davenport | 132/200 |

* cited by examiner

*Primary Examiner* — Tatiana Nobrega
*Assistant Examiner* — Jennifer Gill
(74) *Attorney, Agent, or Firm* — Casimir Jones, S.C.; David Casimir

(57) ABSTRACT

Process and device for making hair buns is disclosed. The invention described here reduces the effort and shortens the amount of time necessary to form a hair bun that remains in place for an extended period of time without the use of bobby pins or other hairpin devices.

7 Claims, 5 Drawing Sheets

COMPOSITIONS AND METHODS FOR MAKING HAIR BUNS

The present application claims priority to U.S. Provisional Pat. Appln Ser. No. 61/856,316 filed Jul. 19, 2013, the disclosure of which is herein incorporated by reference in its entirety.

FIELD OF THE INVENTION

The present invention relates to hair buns, including processes for making hair buns. In particular, the present invention provides processes for making hair buns quickly, easily and painlessly without the use of bobby pins or other hairpin devices.

BACKGROUND OF THE INVENTION

Putting one's hair into a bun is a difficult and time-consuming process. Getting one's hair to stay tightly wrapped in a bun over a period of time is difficult. The difficultly of forming a hair bun and getting it to stay tightly wrapped over a period of time changes with thinner or thicker hair. Decorating one's hair, that has been put into a hair bun, with jewels, beads, feathers or other objects that are appropriately placed in or on the hair to achieve a particular pattern or look is difficult and time consuming. Ensuring a hair bun-forming product is not easily seen through one's hair, over an extended period of time, is difficult. Making a hair bun of a smaller or larger size is difficult. Ensuring a hair bun does not physically cause pain when forming, wearing or removing is difficult. Ensuring a hair bun remains tightly wrapped over time, without the use of bobby pins or other hairpin devices, is difficult. Ensuring one can easily get curls or depth to one's hair after the removal of a hair bun device is difficult. Ensuring a hair bun can be made for both long and shorter shoulder length hair is difficult.

No current hair bun forming process meets all of the needs of a consumer including: easy and fast formation; easy and fast addition of decorative elements; ability to tightly hold together for a period of time; ability to tightly hold together for a period of time without the use of bobby pins or other hairpin devices; ability to hide formation materials; ability to form different bun sizes; painless formation, usage and removal; and ability to accommodate the thickness of one's hair to ensure hair buns made with both thick and thin hair tightly hold together for a period of time.

There are many issues preventing current hair bun processes from meeting consumer needs. Some of the issues include: devices with processes that have too many or too complex parts and/or steps; lack of attached or attachable decorative elements or parts that can be incorporated into a device or process; lack of properties incorporated within the materials of a device or process that compress the hair or hair bun ensuring hold; and lack of a process for enabling different sized hair buns.

However, even with these issues, women prefer hair buns for their versatility. They look professional at work. They look fancy and can be worn when going out. They make exercising easier by keeping long hair out of the eyes. In fact, some sports, like ballet dancing, require hair buns.

There is a need in the market to reduce the effort and shorten the amount of time necessary to form a hair bun that remains in place for an extended period of time. There is a need to reduce the amount of time needed to have decorative elements incorporated into or next to a hair bun. There is a need to reduce the time needed to make a smaller or larger sized hair bun. There is a need to hide formation materials used to form a hair bun. There is a need to limit hair being pulled or skin pinched reducing or negating physical pain. There is a need to produce a hair bun that remains tightly wrapped without regard for hair thickness. There is a need to produce a hair bun that remains tightly wrapped without the use of bobby pins or other hairpin devices. There is a need to easily facilitate the formation of curls and depth in one's hair after the removal of a hair bun device.

SUMMARY OF THE INVENTION

Figure 1:
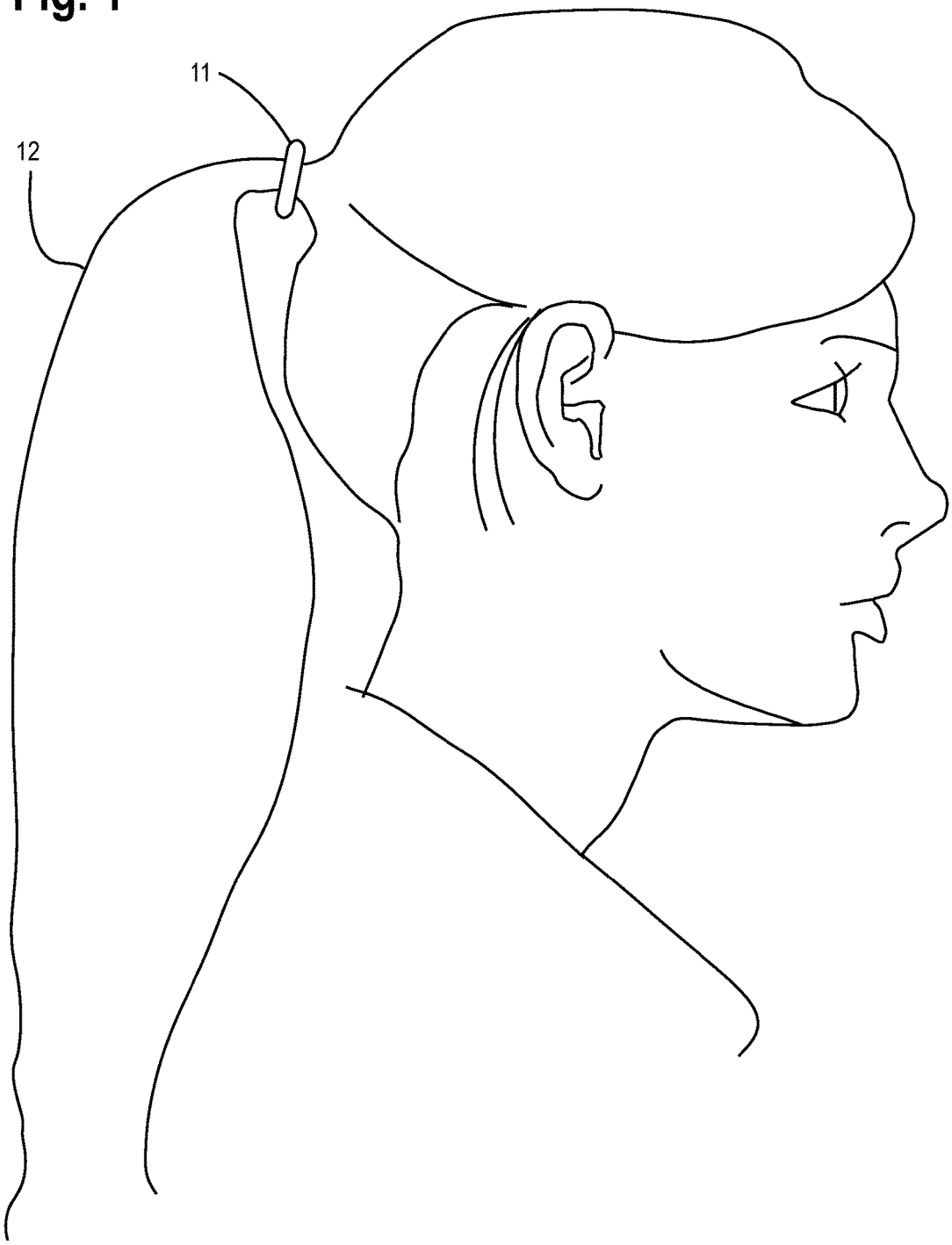
FIG. 1 shows a side view of a band 11 holding hair in a ponytail 12.

The present invention relates to a process for reducing the effort to prepare a hair bun easily without the need for hairpins. Additionally, the present invention relates to a process that shortens the amount of time necessary to form a hair bun that remains in place for an extended period of time. The present invention also relates to a process that reduces the amount of time needed to have decorative elements incorporated into or next to a hair bun. The present also invention relates to a process that reduces the time needed to make a smaller or larger sized hair bun. The present invention also relates to a process that hides formation materials used to form a hair bun. The present invention also relates to a process that limits hair being pulled or skin pinched reducing or negating physical pain. The present invention also relates to a process that produces a hair bun that remains tightly wrapped without regard for hair thickness. The present invention also relates to a process that produces a hair bun that remains tightly wrapped without the use of bobby pins or other hairpin devices. Additionally, the present invention relates to a process that facilitates making a hair bun by one self. Additionally, the present invention relates to a process that facilitates making hair curls and/or giving the hair body after the hair bun is removed. Additionally, the present invention relates to a process that facilitates making hair buns for long and shoulder length hair. The present invention also provides hair buns having the above-described properties. For example, the present invention provides hair buns configured to allow easy preparation into a bun that remains in tightly wrapped in place for an extended period of time without hairpins.

A preferred process for preparing a hair bun with the above mentioned attributes comprises one or more of the steps of: gathering a portion of hair desired to form into a hair bun, and putting a band around said portion of hair closest to the hair roots to form a ponytail; placing said portion of hair formed into a ponytail into an open-ended flexible tube; and spreading hair at the end of the ponytail, furthest from the hair roots, around the edge of the end of said tube, and continually rolling said tube and hair together in an outward motion, wrapping hair underneath said tube until the base of the head is reached, and a hair bun is formed.

A second embodiment for preparing a hair bun with the above mentioned attributes comprises one or more of the steps of: gathering a portion of hair desired to form into a hair bun, and placing said portion of hair formed into an open-ended flexible tube; tightening or cinching the end of said tube closest to the hair roots; and spreading hair at the end of said tube, furthest from the hair roots, around the edge of the end of said tube, and continually rolling said tube and hair together in an outward motion, wrapping hair underneath said tube until the base of the head is reached, and a hair bun is formed.

Another embodiment for preparing a hair bun with the above mentioned attributes comprises one or more of the steps of: gathering a portion of hair desired to form into a hair bun, and putting a band around said portion of hair closest to the hair roots to form a ponytail; placing said portion of hair formed into a ponytail into an open-ended flexible tube with a decorative element attached; and spreading hair at the end of the ponytail, furthest from the hair roots, around the edge of the end of said tube, and continually rolling said tube and hair together in an outward motion, wrapping hair underneath said tube until the base of the head is reached, and a hair bun is formed with a decorative element that is visible.

Yet another embodiment for preparing a hair bun with the above mentioned attributes comprises one or more of the steps of: wetting one's hair; gathering a portion of hair desired to form into a hair bun, and putting a band around said portion of hair closest to the hair roots to form a ponytail; placing said portion of hair formed into a ponytail into an open-ended flexible tube; and spreading hair at the end of the ponytail, furthest from the hair roots, around the edge of the end of said tube, and continually rolling said tube and hair together in an outward motion, wrapping hair underneath said tube until the base of the head is reached, and a hair bun is formed; and then removing the hair bun after several hours until the hair is dry. Hair curls and body to the hair are then visible.

Another embodiment for preparing a hair bun with the above mentioned attributes comprises one or more of the steps of: gathering a portion of hair desired to form into a hair bun, and putting a band around said portion of hair closest to the hair roots to form a ponytail; placing said portion of hair formed into a ponytail into an open-ended flexible tube; and spreading hair at the end of the ponytail, furthest from the hair roots, around the edge of the end of said tube, and continually rolling said tube and hair together in an outward motion, wrapping hair underneath said tube until the base of the head is reached; pulling hair through holes in said tube until a messy hair bun is formed.

Another embodiment for preparing a hair bun with the above mentioned attributes comprises one or more of the steps of: gathering a portion of hair desired to form into a hair bun, and putting a band around said portion of hair closest to the hair roots to form a ponytail; placing said portion of hair formed into a ponytail into an open-ended flexible tube; and spreading hair at the end of the ponytail, furthest from the hair roots, around the edge of the end of said tube, and continually rolling said tube and hair together in an outward motion, wrapping most but not all hair underneath said tube until the base of the head is reached, and a messy hair bun is formed.

Another embodiment for preparing a hair bun with the above mentioned attributes comprises one or more of the steps of: gathering a portion of hair, cut to the shoulder length or longer, desired to form into a hair bun, and putting a band around said portion of hair closest to the hair roots to form a ponytail; placing said portion of hair formed into a ponytail into an open-ended flexible tube that is made of a soft, foldable and stretchy fabric; and spreading hair at the end of the ponytail, furthest from the hair roots, around the edge of the end of said tube, and continually rolling said tube and hair together in an outward motion, wrapping hair underneath said tube until the base of the head is reached; until a hair bun is formed.

Another embodiment for preparing a hair bun with the above mentioned attributes comprises one or more of the steps of: gathering a portion of hair desired to form into a hair bun, and putting a band around said portion of hair closest to the hair roots to form a ponytail; placing said portion of hair formed into a ponytail into an open-ended flexible tube; and spreading hair at the end of the ponytail, furthest from the hair roots, around the edge of the end of said tube, and continually rolling said tube and hair together in an outward motion, wrapping hair underneath said tube until the base of the head is reached; clipping a decorative element onto said tube, and a hair bun is formed with a decorative element that is visible.

Another embodiment for preparing a hair bun with the above mentioned attributes comprises one or more of the steps of: gathering a portion of hair desired to form into a hair bun, and putting a band around said portion of hair closest to the hair roots to form a ponytail; placing said portion of hair formed into a ponytail into a thick open-ended flexible tube; and spreading hair at the end of the ponytail, furthest from the hair roots, around the edge of the end of said tube, and continually rolling said tube and hair together in an outward motion, wrapping hair underneath said tube until the base of the head is reached, and a large hair bun is formed.

Thus, preferred embodiments of the present invention include, but are not limited to, the following methods and compositions:

A process for making a hair bun comprising the steps of:

a. gathering a portion of hair desired to form into a hair bun, and putting a band around said portion of hair closest to the hair roots to form a ponytail,
b. placing said portion of hair formed into a ponytail into an open-ended flexible tube, and
c. spreading hair at the end of the ponytail, furthest from the hair roots, around the edge of the end of said tube, and continually rolling said tube and hair together in an outward motion, wrapping hair underneath said tube until the base of the head is reached, and a hair bun is formed.

In some embodiments, the method comprises the above process, wherein said band comprises one or a plurality of elastic and fabric.

In some embodiments, the method comprises the above process, wherein a decorative element is affixed to the hair and/or said open-ended flexible tube so that a particular decorative pattern is displayed on or in the hair.

In some embodiments, the method comprises the above process, wherein said decorative element is interchanged with another decorative element using an apparatus such as a hook, clip or loop affixed to said open-ended flexible tube.

In some embodiments, the method comprises the above process, wherein said open-ended flexible tube is comprised of one or a plurality of synthetic or natural materials such cotton, silk, wool, acrylic, nylon, rayon, acetate, lastex, Kevlar, elastic, polyester, and/or spandex to form a lightweight and stretchable fabric.

In some embodiments, the method comprises the above process, wherein said fabric is made with a thickness of 1 cm or less (e.g., 0.7 cm or less, 0.5 cm or less, 0.3 cm or less, 0.1 cm or less, etc., or dimensions therein between) so that the hair bun is formed with more or less volume.

In some embodiments, the method comprises the above process, wherein said fabric has a stretch of 100% or less (e.g., 90% or less, 80% or less, 70% or less, 50% or less, etc., or stretch therein between).

In some embodiments, the method comprises the above process, wherein said open-ended flexible tube has a width of 4 inches or less (e.g., 3 inches or less, 2 inches or less etc., 4 cm or less, 3 cm or less, 2 cm or less, etc., or dimensions therein between), and a length of 10 inches or less (e.g., 9 inches or less, 8 inches or less, 7 inches or less, 6 inches or less, 5 inches or less, 10 cm or less, 9 cm or less, 8 cm or less, 7 cm or less, 6 cm or less, 5 cm or less, etc., or dimensions therein between).

In some embodiments, the dimensions are greater in value than those listed above.

In some embodiments, the method comprises the above process, wherein the hair is wet or moist prior to putting it in said open-ended flexible tube.

In some embodiments, the method comprises the above process, wherein said open-ended flexible tube is rolled into a donut shape before the user's hair is put inside it.

In some embodiments, the method comprises the above process, wherein said open-ended flexible tube matches the color of the user's hair.

In some embodiments, the method comprises the above process, wherein a portion of hair is not wrapped underneath tube so that bun looks messy.

In some embodiments, the method comprises a process for making a hair bun comprising the steps of:

a. gathering a portion of hair desired to form into a hair bun, and placing said portion of hair formed into an open-ended flexible tube,
b. tightening or cinching the end of said tube closest to the hair roots, and
c. spreading hair at the end of said tube, furthest from the hair roots, around the edge of the end of said tube, and continually rolling said tube and hair together in an outward motion, wrapping hair underneath said tube until the base of the head is reached, and a hair bun is formed.

In some embodiments, the method comprises a process for making a hair bun comprising the steps of:

a. gathering a portion of hair desired to form into a hair bun, and putting a band around said portion of hair closest to the hair roots to form a ponytail,
b. rolling said open-ended flexible tube into a donut shape before the user's hair is put inside it,
c. placing said portion of hair formed into a ponytail into said donut shaped open-ended flexible tube, and
d. spreading hair at the end of the ponytail, furthest from the hair roots, around the edge of the end of said donut shaped tube, and continually rolling said tube and hair together in an outward motion, wrapping hair underneath said tube until the base of the head is reached, and a hair bun is formed.

In some embodiments, the methods are applies to a human head having natural hair. In other embodiments, the methods are applied to synthetic hair (e.g., a wig). In some embodiments, the methods are applied to natural or synthetic hair on a non-natural subject (e.g., a mannequin, display bust, etc.).

Also provided herein are kits, systems, and devices that find use in any of the above methods. For example, in some embodiments, a kit comprising one or more or all of: one or more bands (e.g., of the same size, of different sizes, different thicknesses, different colors, etc.), one or more flexible tubes (e.g., of the same size, of different sizes, different thicknesses, different colors, etc.), instructions for use (e.g., pictorial, video (e.g., provided via software), or other representations of one or more of the steps described herein; optionally along with associated text or audio directions), one or more decorative elements, one or more fasteners for connecting a decorative element to a band, a flexible tube, or to a subject's hair (the fastener may be attached or associated with the decorative element or the band), and one or more other hair care products or accessories. In some embodiments, kit components are provided in a box or other container. In some embodiments, the box contains images or text that describe the contents of the kit.

DETAILED DESCRIPTION OF THE INVENTION

The present invention relates to a process for preparing a hair bun that can be formed quickly and easily by one's self. Additionally, it is preferred to have the hair bun stay tightly wrapped for an extended period of time. Additionally, it is preferred to have the hair bun stay tightly wrapped for an extended period of time for consumers with both thick and thin hair. Additionally, it is preferred to have decorative elements easy to incorporate next to or into a hair bun. Additionally, it is preferred to conceal the materials used to make the hair bun. Additionally, it is preferred to have the hair bun pain free to form, wear or remove. Additionally, it is preferred to be able to form larger or smaller sized hair buns. Additionally, it is preferred to be able have curls or body to one's hair after the hair bun is removed. Additionally, it is preferred to be able to form a hair bun with shoulder length or longer hair.

There are other processes for inserting hair into materials known in the art, including but not limited to the systems described in U.S. Pat. No. 8,136,534, incorporated herein by reference in its entirety.

In one embodiment of the present invention, a fabric is utilized for the open-ended flexible tube. In one embodiment, the fabric is sewn or knitted into one piece together using an appropriate sewing or knitting apparatus. In one embodiment, an automated knitting machine is used that has a needle count of 96. In one embodiment, the diameter of each end of the tube is 4 inches; and the length of the tube is 10 inches. In another embodiment, the diameter of each end of the tube is 2.5 inches; and the length of the tube is 8 inches. In another embodiment, the fabric is very stretchy with a 100% stretch that compresses the hair and hair bun upon rolling. In another embodiment, the fabric is made out of a spandex and polyester blend. In another embodiment, the fabric is preshrunk.

In other embodiments: the diameter of each end is larger or smaller than 3 inches; each end has a different sized diameter; the fabric is made of different materials or yarn; the fabric is treated with a stiffener, such as starch and water, by the user prior to forming the hair bun; the fabric is treated with a fabric stiffener in the manufacturing process; the fabric is different colors; the length of the tube is shorter or longer; the hair bun is heated, with a hair dryer for example, after it is formed; the tube is sewn or knitted to be straight vertically and/or sewn or knitted to have angles, ribs or ridges; the tube is made of different types of fabric at the ends; the tube is made with fabric to enable a different level of stretch at the ends; the tube is sewn or knitted to produce a different level of stretch at the ends; the tube has elastic sewn or knitted into the fabric at the ends; the tube has elastic sewn or knitted into the fabric throughout the tube.

There are other processes for creating hair buns, hair styling devices, and hair decorative elements known in the art, including but not limited to the systems described in U.S. Pat. Nos. 6,047,708, 7,631,647, 7,293,566, 6,189,543, 2,558,100, 6,227,207, 5,303,723, 5,472,003, 5,727,575, 5,826,593, 6,260,559, 7,293,566, 7,305,995 incorporated herein by reference in its entirety.

In one embodiment in the present invention, a decorative element is sewn to the end of the tube that will be placed next to the head using an appropriate sewing or knitted apparatus. In one embodiment, an apparatus, such as a hook, clip or loop, is included on the tube and/or decorative element so that different decorative elements can be removed, attached, or changed. In one embodiment, decorative elements are attached before, during or after the tube and hair are being rolled.

In one embodiment, a 4 mm thick elastic hair band is used to make a ponytail. In other embodiments, the tube is made of a thinner or thicker material that allows for a hair bun to be formed with more or less volume.

In some embodiments, the tube is rolled first in a donut shape, before the user's hair is put inside it; the user then puts a portion of their hair into the rolled tube, placing the rolled tube near the base of the head, and tucks the hair around the tube to form a hair bun.

In some embodiments, the tube is rolled first, before the user's hair is put inside it; the user then puts a portion of their hair into the rolled tube, placing the rolled tube at the end farthest from the head, and folds, rolls and/or wraps the hair and tube together into a hair bun.

In still other embodiments, the tube matches the color of the hair to ensure that it cannot be easily detected.

In some embodiments, the hair bun stays tightly wrapped for 2 to 18 hours.

In some embodiments, first, a portion of hair is put into an elastic band, and the band is twisted several times near the user's head to form a ponytail. Second, the hair in the ponytail is pulled through the center of the open-ended flexible tube. Third, the user, starting at the end of the ponytail furthest from the hair roots, spreads the hair around the edge of the end of the tube, and continually rolls the open-ended flexible tube and hair together in an outward motion, wrapping hair underneath the tube until the base of the head is reached, and a hair bun is formed.

EXAMPLES

Several examples of the present invention are provided below. These examples are provided in order to demonstrate and further illustrate certain preferred embodiments and aspects of the present invention and are not to be construed as limiting the scope thereof.

Figure 2:
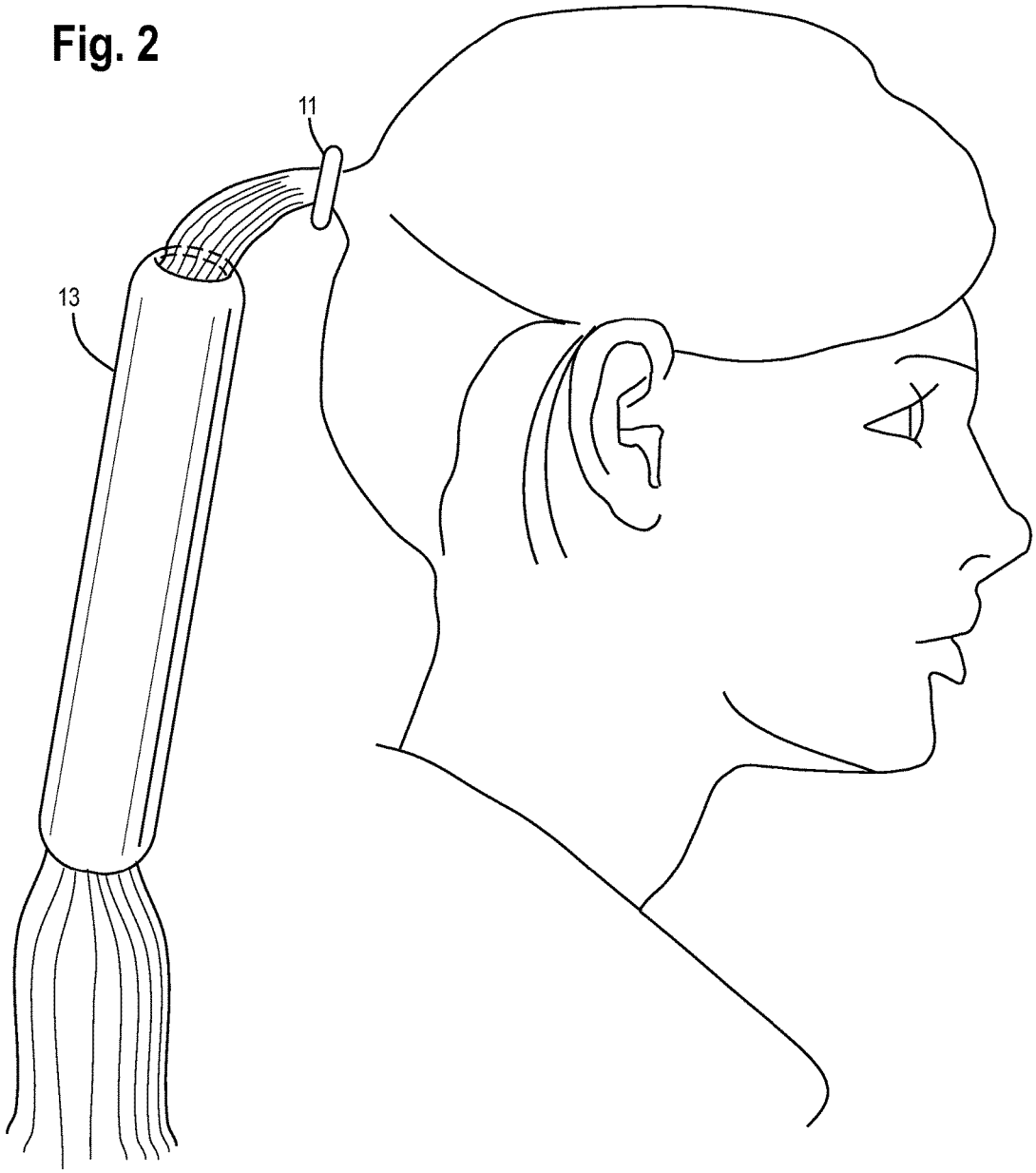
FIG. 2 shows a side view of hair from a ponytail 12 inserted into an open-ended flexible tube 13.
Figure 3:
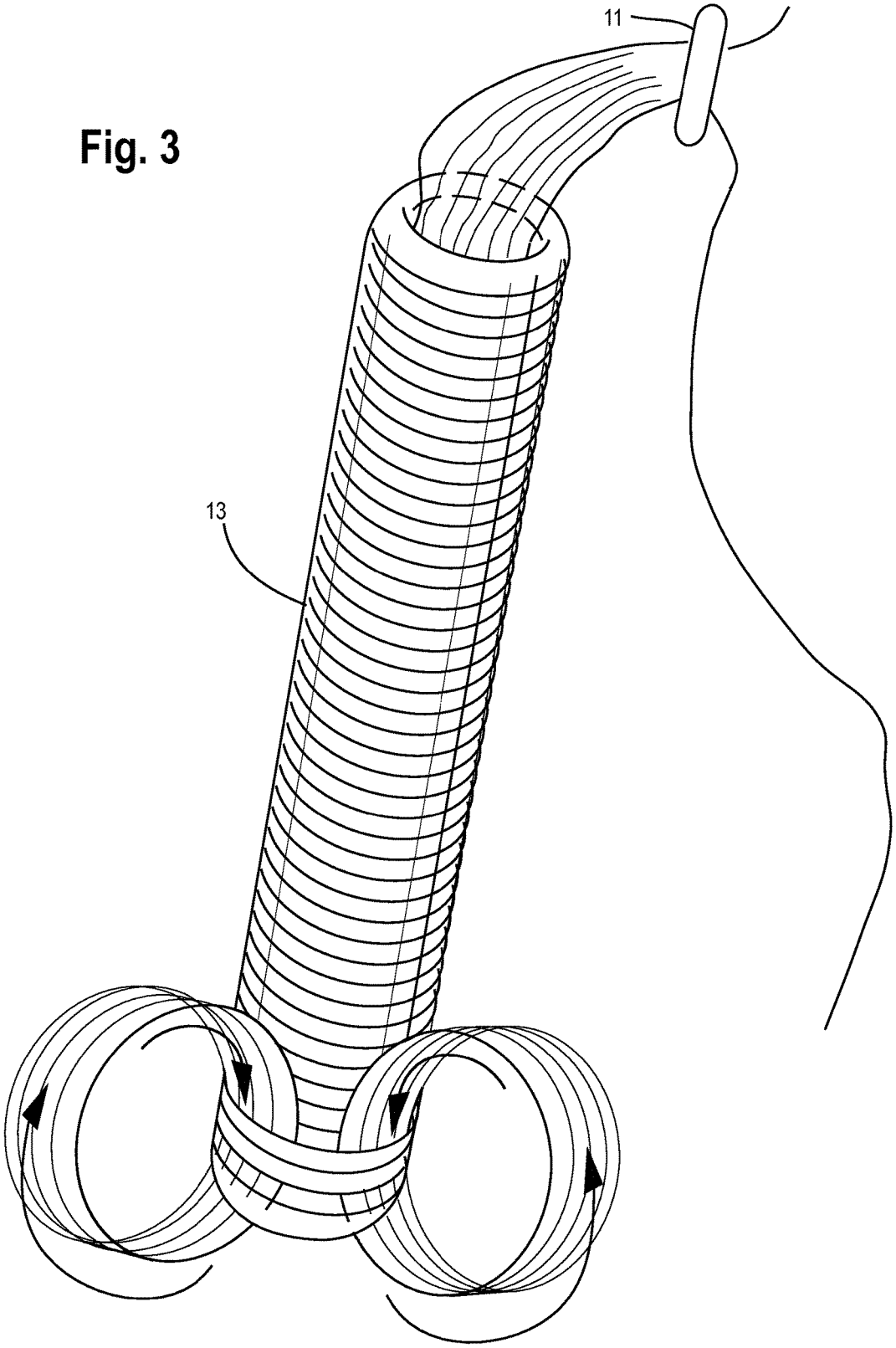
FIG. 3 shows hair being spread around the edge of the end of an open-ended flexible tube 13, and the tube 13 and hair being rolled together in an outward motion, wrapping hair underneath the tube 13.
Figure 4:
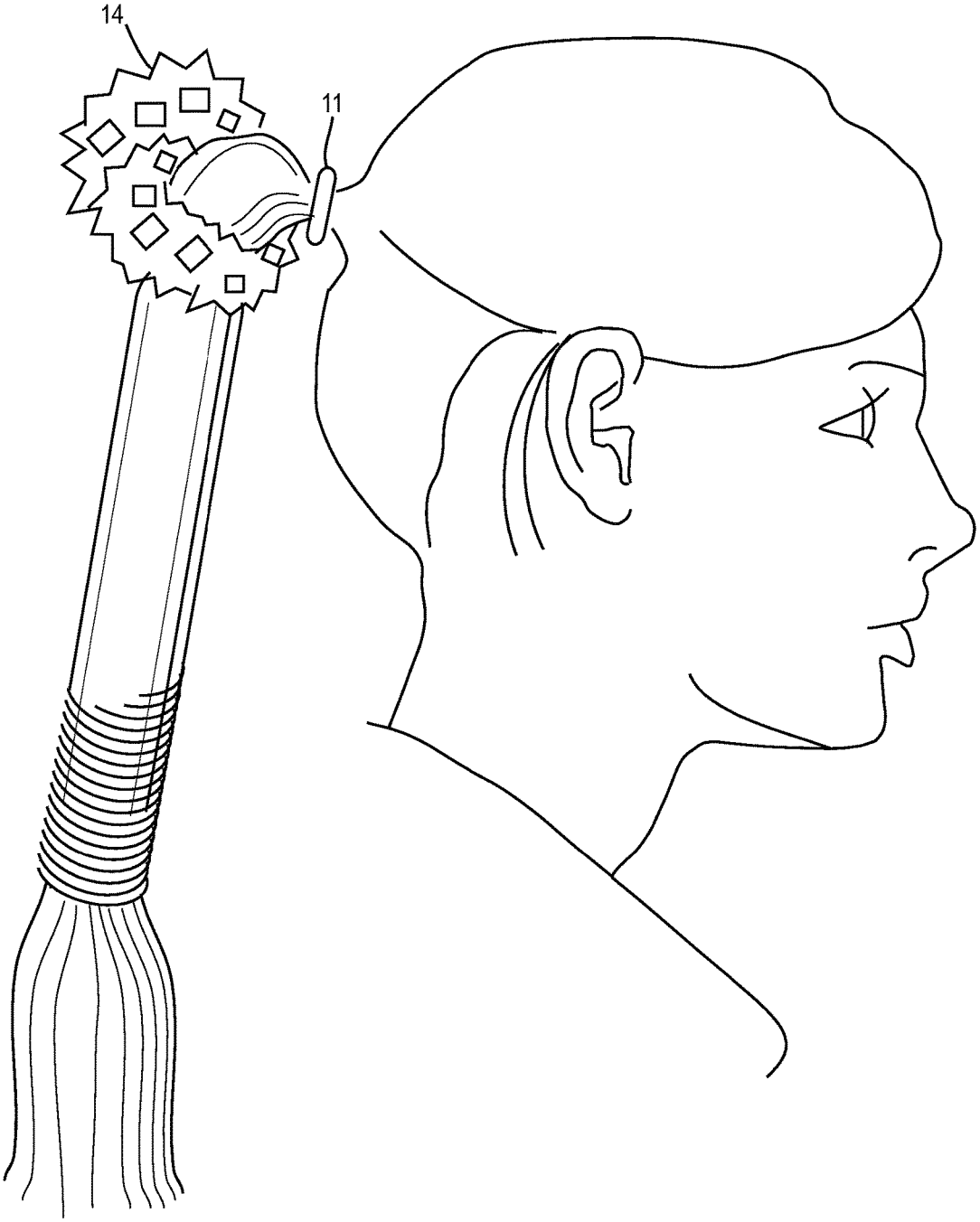
FIG. 4 shows a side view of an example of one type of decorative element 14 affixed to the end of an open-ended flexible tube 13.
Figure 5:
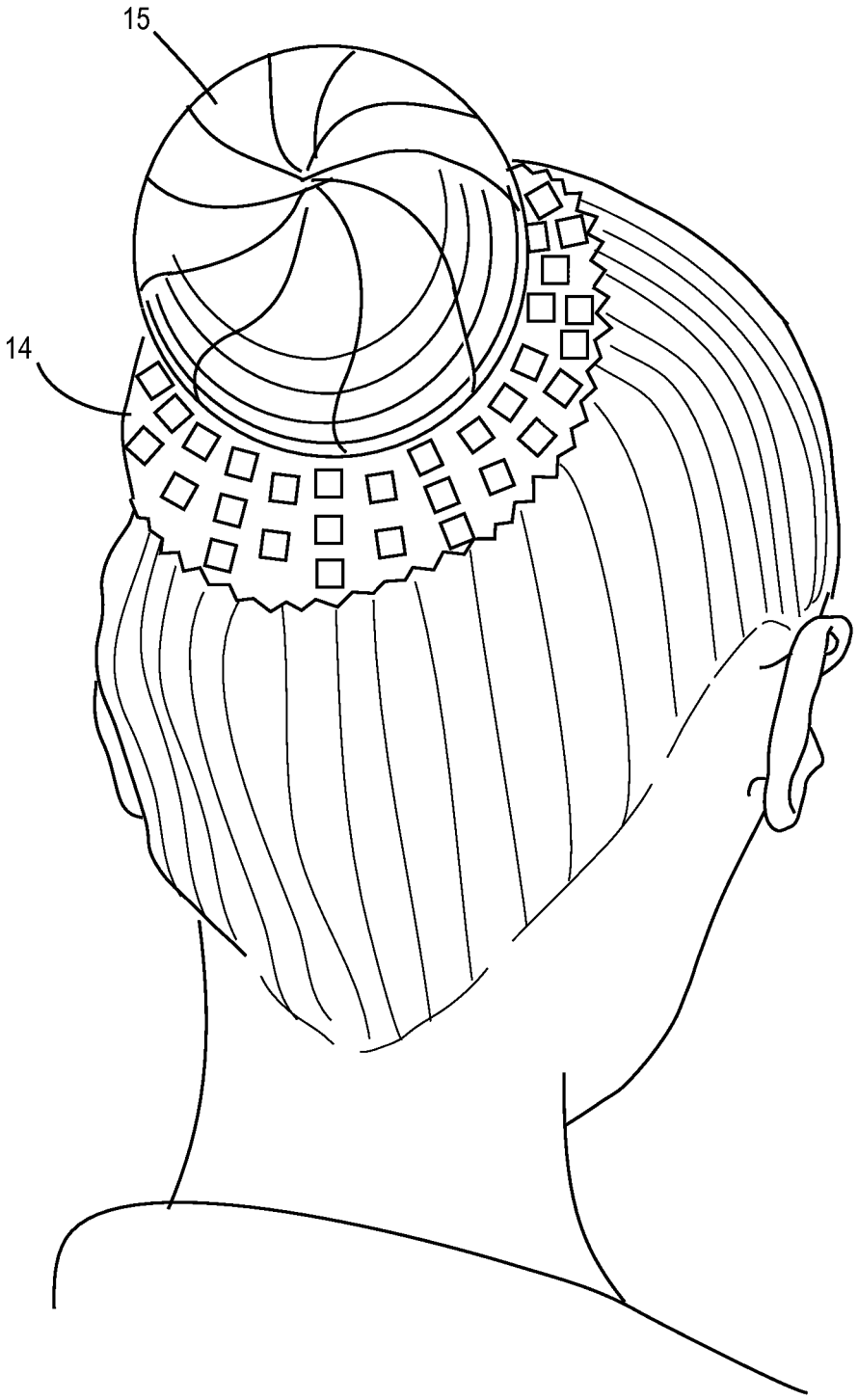
FIG. 5 shows the back view of an example of one type of decorative element 14 and hair bun 15.

In one preferred embodiment of the invention, a hair bun is prepared in the following manner (referencing FIGS. 1-5): first, a portion of hair is put into the band 11, and the band is twisted several times near the user's head to form a ponytail 12; second, the hair in the ponytail 12 is put through the open-ended flexible tube 13 so that a decorative element 14, affixed to the open-ended flexible tube 13, is closest to the head; third, the user then, in an outward motion, continually rolls the open-ended flexible tube 13 and wraps hair underneath it until the base of the head is reached, and a hair bun 15 is formed.

In yet other preferred embodiments, a decorative element 14 is not used. In yet other preferred embodiments, the band 11 is an elastic band with a diameter of 5 mm or less.

In some embodiments, the tube 13 is tightened at the end closest to the head prior to folding and wrapping the tube. In some embodiments, the tube 13 is tightened at the end closest to the head during or after folding and wrapping the tube 13. In yet other embodiments, the tube is tightened by cinching a cord placed inside the tube 13 at the base of the head. In some embodiments, other portions of the tube are tightened. In yet other embodiments, the end of the tube is tightened with a drawstring. In some embodiments, a band 11 is put on a portion of the hair first, and is made out of elastic and fabric, to form a ponytail 12 prior to inserting the hair into the open-ended tube 13. In embodiments where a ponytail 12 is put on a portion of the hair first, the tube 13 may not be tightened. In other embodiments, an elastic band 11 and open-ended tube 13 are combined in one piece.

In some embodiments, a decorative element 14 is attached to the open-ended flexible tube 13 once the hair bun 15 is nearly completed or completed. In some embodiments, the decorative element 14 is attached to loops sewn or knitted into or onto the tube 13. In other embodiments, a decorative element 14 is added to the hair or hair bun 15 after the hair bun is completed. In some embodiments, this invention has removable or fixed decorative elements 14 attached to the tube 13 or elastic band 11 so that a particular decorative pattern or look can be easily displayed in or on one's hair.

In other embodiments, the tube 13 is made of a synthetic or natural material, like fabric or rubber. In yet other embodiments, the tube's 13 material may stretch, compress the hair, become rigid after drying, or retain or wick away moisture to hold the hair in a bun 15 for an extended period of time, accommodate different hair thicknesses, or add or decrease hair bun size. In still other embodiments, the hair is wet or moist prior to putting it in the tube 13 causing curls or body to the hair after the hair bun is removed. In other embodiments, the tube 13 is moistened with water prior to using it to form a hair bun 15. In other embodiments, a stiffening agent is applied to the tube 13, by the user, prior to forming the hair bun 15. In yet other embodiments, the thickness of the tube 13 is increased so as to make a larger hair bun 15. In still other embodiments, some hair is not folded underneath the tube 13, and the hair bun 15 looks messy. In yet other embodiments, hair is pulled out of holes in the tube 13 to make the hair bun 15 look messy.

We claim:

1. A process for making a hair bun comprising the steps of:

a. gathering a portion of hair desired to form into a hair bun, and putting a band around said portion of hair closest to hair roots to form a ponytail, b. placing said portion of hair formed into a ponytail into an open-ended flexible tube having a first open end positioned nearest said hair roots and a second open end most distal from said hair roots, and c. spreading hair at an end of the ponytail, furthest from the hair roots, around an edge of said second open end of said tube, and continually rolling said tube and hair together in an outward motion, wrapping hair underneath said tube, and moving said second open end towards said first open end, until a hair bun is formed.

2. The process of claim 1, wherein said band comprises a material selected from the group consisting of elastic and fabric.

3. The process of claim 1, wherein a decorative component is affixed to the hair near said hair root or said first open end of said open-ended flexible tube so that said decorative component is displayed on or in the hair following formation of said hair bun.

4. The process of claim 1, wherein said open-ended flexible tube is comprised of one or a plurality of synthetic or natural materials selected from the group consisting of cotton, silk, wool, acrylic, nylon, rayon, acetate, lastex, Kevlar, elastic, polyester, and spandex to form a lightweight and stretchable fabric.

5. The process of claim 4, wherein said fabric is made with a thickness of 1 cm or less.

6. The process of claim 1, wherein the hair is wet prior to putting it in said open-ended flexible tube.

7. The process of claim 1, wherein said open-ended flexible tube matches a color of said hair.

* * * * *